US011969039B2

(12) United States Patent
Thornton

(10) Patent No.: US 11,969,039 B2
(45) **Date of Patent: *Apr. 30, 2024**

(54) TRIM PIECE ASSEMBLY FOR AN ARTICLE OF APPAREL

(71) Applicant: NIKE, Inc., Beaverton, OR (US)

(72) Inventor: Jessica Lynne Thornton, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/742,240

(22) Filed: May 11, 2022

(65) Prior Publication Data

US 2022/0264976 A1 Aug. 25, 2022

Related U.S. Application Data

(62) Division of application No. 17/026,977, filed on Sep. 21, 2020, now Pat. No. 11,357,276.

(Continued)

(51) Int. Cl.

*A41D 27/08* (2006.01)
*A41D 1/04* (2006.01)

(Continued)

(52) U.S. Cl.

CPC ..... *A41D 27/08* (2013.01); *A41D 1/04* (2013.01); *A41D 1/06* (2013.01); *A41D 3/00* (2013.01);

(Continued)

(58) Field of Classification Search

CPC ..... A41D 2200/20; A41D 1/04; A41D 1/02; A41D 3/00; A41D 3/005; A41D 3/02;

(Continued)

(56) References Cited

U.S. PATENT DOCUMENTS 2,581,366 A 1/1952 De Grazia
2,702,387 A * 2/1955 Wenzel ..... A41D 27/02 2/97

(Continued)

FOREIGN PATENT DOCUMENTS

DE 20118164 U1 1/2002
EP 1262113 A1 12/2002
EP 3162231 A1 5/2017

OTHER PUBLICATIONS

Tokens, Eve. "What is Facing in Sewing (and How to Get that Professional Finish)". thecreativecurator.com, Sep. 29, 2016, https://www.thecreativecurator.com/4-fantastic-facings/. Accessed Aug. 22, 2023. (Year: 2016).*

(Continued)

*Primary Examiner* — Jameson D Collier
*Assistant Examiner* — Matthew R Marchewka
(74) *Attorney, Agent, or Firm* — Shook, Hardy & Bacon L.L.P.

(57) ABSTRACT

Aspects herein are directed to a trim piece assembly that can be incorporated into an article of apparel, where the trim piece assembly is used to house a drawcord. The trim piece assembly is constructed and incorporated into the article of apparel in such a way that there is no topstitching on the external-facing surface of the article of apparel in areas where the trim piece assembly is located.

15 Claims, 7 Drawing Sheets

Related U.S. Application Data

(60) Provisional application No. 62/936,801, filed on Nov. 18, 2019.

(51) Int. Cl.
*A41D 1/06* (2006.01)
*A41D 3/00* (2006.01)
*A41D 27/02* (2006.01)

(52) U.S. Cl.
CPC ..... *A41D 27/02* (2013.01); *A41D 2200/20* (2013.01); *A41D 2300/33* (2013.01); *A41D 2500/10* (2013.01)

(58) Field of Classification Search
CPC . A41D 3/04; A41D 3/08; A41D 27/02; A41D 27/08; A41D 27/14; A41D 27/145; A41D 27/16; A41D 31/02; A41D 2300/33; A41D 2300/332; A41D 2300/50; A41B 2300/33; A41B 2300/35; A42B 1/04; A42B 1/048; A42B 1/045; A41F 1/00; Y10T 428/2419; Y10T 428/24198; Y10T 428/24207
USPC ..... 2/84, 69.5, 88, 89, 93, 98
See application file for complete search history.

(56) References Cited

U.S. PATENT DOCUMENTS

| | | | |
|---|---|---|---|
| 2,751,599 | A | 6/1956 | Peterson |
| 2,994,091 | A | 8/1961 | Aftergood, Jr. |
| 4,334,325 | A | 6/1982 | Walkuski |
| 5,040,244 | A | 8/1991 | Tubbs |
| 5,960,478 | A | 10/1999 | Sivret et al. |
| 6,370,692 | B1 | 4/2002 | Duyn et al. |
| 6,374,418 | B1 | 4/2002 | Rindle |
| 8,209,822 | B2 | 7/2012 | Okot |
| 10,070,674 | B1 | 9/2018 | Beckers |
| 10,537,144 | B1 | 1/2020 | Suttman et al. |
| 2003/0192108 | A1 | 10/2003 | Vidal |
| 2008/0078012 | A1 | 4/2008 | Mario |
| 2010/0275344 | A1 | 11/2010 | Demarest et al. |
| 2013/0031695 | A1 | 2/2013 | Roemer et al. |
| 2014/0317829 | A1 | 10/2014 | Rolfe |
| 2014/0331385 | A1 | 11/2014 | Okies et al. |
| 2016/0015104 | A1 | 1/2016 | Edwards et al. |
| 2016/0150847 | A1 | 6/2016 | Johnson |
| 2017/0295870 | A1 | 10/2017 | Harris et al. |
| 2017/0314176 | A1 | 11/2017 | Demarest et al. |
| 2017/0325530 | A1* | 11/2017 | Etheridge ..... D06B 11/0096 |
| 2017/0325531 | A1* | 11/2017 | Lomax ..... A41F 1/02 |
| 2018/0271189 | A1 | 9/2018 | Hussey et al. |
| 2019/0021423 | A1 | 1/2019 | Fayle et al. |
| 2021/0145096 | A1 | 5/2021 | Thornton |

OTHER PUBLICATIONS

International Preliminary Report on Patentability received for PCT Patent Application No. PCT/US2020/055677, dated Jun. 2, 2022, 9 pages.

* cited by examiner

TRIM PIECE ASSEMBLY FOR AN ARTICLE OF APPAREL

CROSS-REFERENCE TO RELATED APPLICATIONS

This application, entitled "Trim Piece Assembly for an Article of Apparel," is a divisional application of U.S. application Ser. No. 17/026,977, filed Sep. 21, 2020 and entitled "Trim Piece Assembly for an Article of Apparel," which claims the benefit of priority of U.S. Provisional Application No. 62/936,801, filed Nov. 18, 2019 and entitled "Trim Piece Assembly for an Article of Apparel." The entireties of the aforementioned applications are incorporated by reference herein.

TECHNICAL FIELD

Aspects herein are directed to a trim piece assembly for an article of apparel where the trim piece assembly may be used to house a drawcord.

BACKGROUND

Traditional constructions used to house a drawcord are typically formed by folding inwardly a perimeter edge of, for instance, a hood or a waistband and securing the edge to the inner-facing surface of the hood or waistband to form a tunnel structure in which the drawcord is contained. The attachment of the edge to the hood or waistband is typically done by topstitching which is visible on the outer-facing surface of the hood or waistband. This may create a less-than-desirable aesthetic.

BRIEF DESCRIPTION OF THE FIGURES

Examples of aspects herein are described in detail below with reference to the attached drawing figures, wherein.

DETAILED DESCRIPTION

Figure 1:
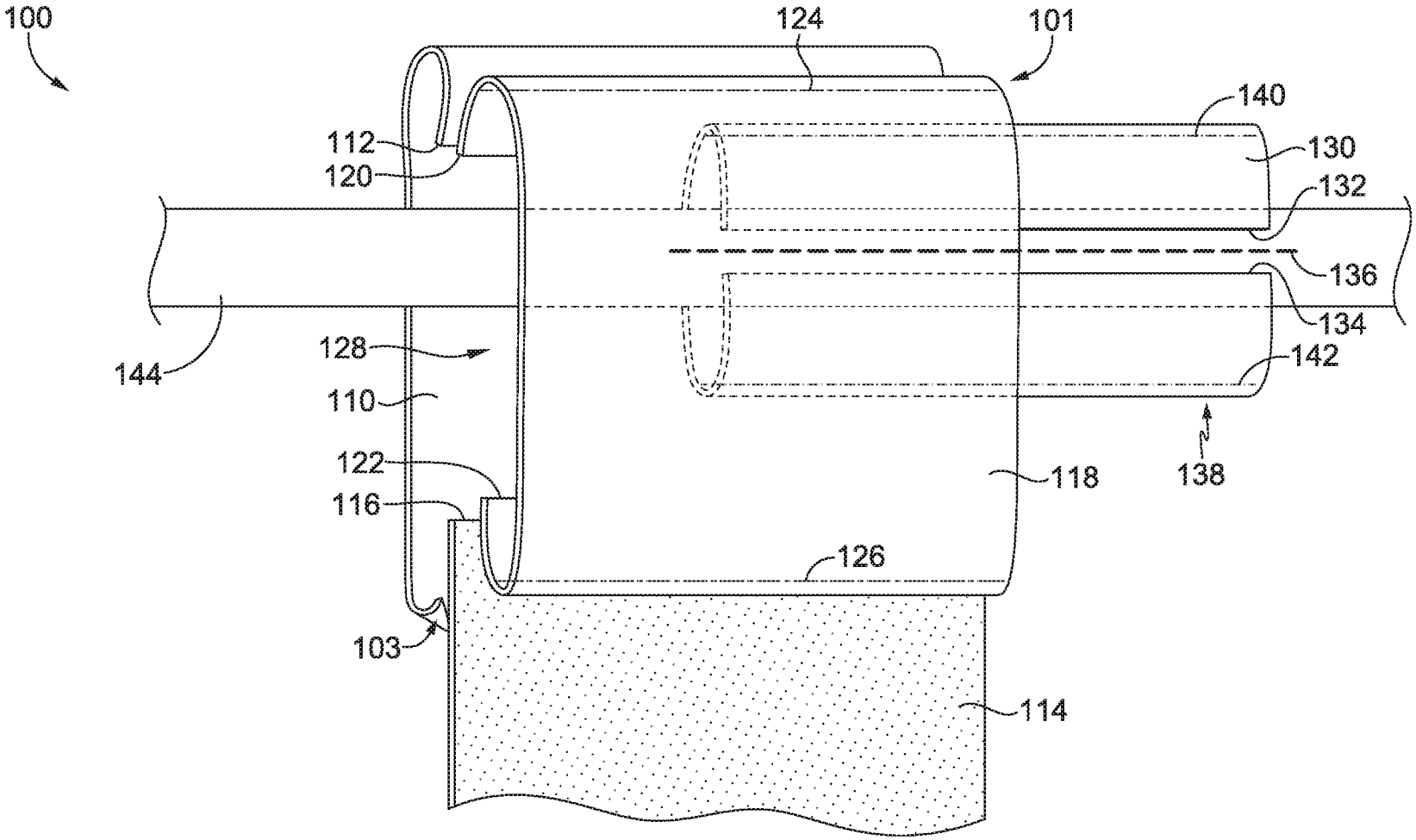
FIG. 1 illustrates a view of a trim piece assembly used to house a drawcord in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Constructions used to house drawcords on typical articles of apparel are generally formed by folding a perimeter edge of an exterior layer of the article of apparel inward and securing the perimeter edge to the exterior layer using topstitching to form a tunnel structure in which a drawcord is positioned. Other constructions may utilize a trim piece that forms a tunnel structure and securing the trim piece to the exterior layer using topstitching. In these examples, the topstitching and/or an outline of the drawcord, is visible on the external-facing surface of the article of apparel which may not be desirable when a clean or minimalistic aesthetic is the goal. Aspects herein provide for a trim piece assembly that may be used to house a drawcord, where the trim piece assembly is formed and incorporated into an article of apparel in such a way that there is no visible stitching on the external-facing surface of the article of apparel in areas where the trim piece assembly is located. In addition, an outline of the drawcord is generally not visible on the external-facing surface of the article of apparel. Both of these feature help to create a clean aesthetic.

At a high level, aspects herein are directed to a trim piece assembly for an article of apparel where the article of apparel is formed, or at least partially formed, from an exterior layer having a perimeter edge. The perimeter edge may form an edge of a waist opening, a face opening of a hood, a sleeve opening of a sleeve, a leg opening of a pant or short, and the like. The article of apparel also includes a lining layer that lines, in whole or in part, an interior of the article of apparel. A first trim piece is positioned internal to the exterior layer, and a first edge of the first trim piece is affixed to the perimeter edge of the exterior layer, and a second opposite edge of the first trim piece is affixed to a lining layer edge of the lining layer. A second trim piece that is partially folded along its length to form a tunnel structure is positioned in a space formed between opposing surfaces of the first trim piece and the exterior layer and is affixed at one or more locations to the first trim piece but is unaffixed from the exterior layer. A drawcord is positioned within the tunnel structure formed by the second trim piece, where the drawcord may be used to adjust the circumference of the opening defined by the perimeter edge of the exterior layer. Because the second trim piece is unaffixed from, or not attached to the exterior layer, the exterior layer does not include topstitching in areas where the trim piece assembly is located. Moreover, by positioning the drawcord within the tunnel structure formed by the second trim piece, an outline of the drawcord is generally not visible on the external-facing surface of the article of apparel.

As used herein, the term "article of apparel" encompasses any number of products meant to be worn by a wearer including upper-body garments (e.g., shirts, jackets, hoodies, pullovers), lower-body garments (e.g., pants, shorts, leggings), portions of upper-body garments and/or lower-body garments such as hoods, sleeves, and/or leg portions, articles of footwear such as shoes or socks, articles of headwear (e.g., hats and hoods), gloves, stand-alone sleeves (e.g., arm sleeves, calf sleeves), and the like.

Positional terms used when describing the article of apparel such as front, back, internal-facing surface, external-facing surface, exterior, interior, internal, and the like are with respect to the article of apparel being worn as intended with the wearer standing upright. As such, when the article of apparel is in the form of a hood, an upper-body garment, or a lower-body garment, the internal-facing surface of the article of apparel is configured to face inwardly toward a wearer, and the external-facing surface of the article of apparel is configured to face toward the external environment. When describing the trim piece assembly, the internal-facing surface of the trim piece assembly is configured to face inwardly (i.e., toward a wearer), and the external-facing surface is configured to face outwardly (i.e., away from the wearer). The term "internal" when describing, for instance, the positioning of the first trim piece with respect to the exterior layer means that the first trim piece is positioned on the inside or interior of the article of apparel and may form, at least in part, the internal-facing surface of the article of apparel. The term "edge" as used herein may mean a terminal end or edge of a layer of material or it may mean a folded edge of a layer of material.

The term "affixed" or "affixing" as used herein generally means the permanent attachment of one material to another material using affixing technologies such as stitching, bonding, spot welding, adhesives, and the like. In one example aspect, the term affixing means stitching one material to another material at a seam line using, for instance, a thread material. The term "topstitch" or "topstitching" as used herein means one or more lines of stitching that are visible on the external-facing surface of an article of apparel.

Unless indicated otherwise, all measurements provided herein are taken when the article of apparel and/or trim piece assembly are at standard ambient temperature and pressure (298.15 K and 100 kPa) and the article of apparel and/or trim piece is in a resting state (e.g., an unstretched state).

FIG. 1 illustrates a view of a portion of an example trim piece assembly 100 that can be incorporated into an article of apparel such as, for example, a hood, a waistband, and the like. The trim piece assembly includes an internal-facing surface 101 and an opposite external-facing surface 103. The view shown in FIG. 1 is taken from the perspective of the internal-facing surface 101 of the trim piece assembly 100. The use of even-length dashed lines indicates that a structure, or a portion of a structure, is generally hidden from view by another structure. The trim piece assembly 100 includes an exterior layer 110. In example aspects, the exterior layer 110 may form all or part of an external-facing surface of an article of apparel. The exterior layer 110 includes a perimeter edge 112. When the article of apparel is in the form of a hood, for instance, the perimeter edge 112 may define, or at least partially define, a face opening of the hood. When the article of apparel is in the form of a lower-body garment, for example, the perimeter edge 112 may define, or at least partially define, a waist opening of the lower-body garment. Other examples include the perimeter edge 112 defining a sleeve opening, a leg opening, a waist opening of an upper-body garment, and the like. The perimeter edge 112 is shown folded inwardly (i.e., in a direction towards the internal-facing surface 101 of the trim piece assembly 100), but it is also contemplated herein that the perimeter edge 112 may not be folded. In example aspects, the exterior layer 110 may be formed of a first material such as a knit material, a woven material, and/or a non-woven material.

The trim piece assembly 100 further includes a lining layer 114 where the lining layer 114 is positioned internal to the exterior layer 110. The lining layer 114 may line, in whole or in part, the article of apparel. For example, when the article of apparel is in the form of a hood, the lining layer 114 may line the interior of the hood such that the lining layer 114 forms, or at least partially forms, an internal-facing surface of the hood. When the article of apparel is in the form of a lower-body garment, the lining layer 114 may line, in whole or in part, the interior of the lower-body garment such that the lining layer 114 forms, or at least partially forms, an internal-facing surface of the lower-body garment. The lining layer 114 includes a lining layer edge 116. Although shown as not folded, it is contemplated herein that the lining layer edge 116 may be folded inwardly (e.g., towards the internal-facing surface 101 of the trim piece assembly 100) or outwardly (e.g., towards the external-facing surface 103 of the trim piece assembly 100). In example aspects, the lining layer 114 may be formed of a second material that is selected so as not to add significant weight to a resulting article of apparel, to reduce manufacturing costs, and/or to improve the drape or pliability of the lining layer 114. In example aspects, the second material used to form the lining layer 114 may be different from the first material used to form the exterior layer 110.

The trim piece assembly 100 further includes a first trim piece 118 that is positioned internal to the exterior layer 110. In example aspects, the first trim piece 118 may be formed from the same material (e.g., the first material) as the exterior layer 110 to provide a consistent appearance between the external-facing surface of an article of apparel incorporating the trim piece assembly 100 and the portion of the trim piece assembly 100 immediately adjacent but internal to the perimeter edge 112 of the exterior layer 110. The first trim piece 118 includes a first edge 120 and a second edge 122 opposite the first edge 120 where each of the first edge 120 and the second edge 122 is a longitudinal edge. In example aspects, each of the first edge 120 and the second edge 122 is folded toward the external-facing surface 103 of the trim piece assembly 100. However, it is also contemplated herein that one or more of the first edge 120 and the second edge 122 are not folded. Any and all aspects, and any variation thereof, are contemplated as being within aspects herein.

The first edge 120 of the first trim piece 118 is affixed to the perimeter edge 112 of the exterior layer 110 by, for instance, stitching, to form a first seam line 124 (shown as a long-and-short broken line). The second edge 122 of the first trim piece 118 is affixed to the lining layer edge 116 of the lining layer 114 by, for instance, stitching to form a second seam line 126 (shown as a long-and-short broken line). This configuration creates a space 128 between the opposing surfaces of the exterior layer 110 and the first trim piece 118 where the space 128 extends along a longitudinal length of the trim piece assembly 100. Although stitching is described as one way to affix the edges of the first trim piece 118 to the perimeter edge 112 and the lining layer edge 116, it is contemplated herein that other affixing technologies described above may be used. In example aspects, the lining layer 114 is unattached from the exterior layer 110, and is only attached to the first trim piece 118 be way of the second seam line 126.

The trim piece assembly 100 further includes a second trim piece 130 having a first longitudinal edge 132 and a second longitudinal edge 134 opposite the first longitudinal edge 132. In example aspects, each of the first longitudinal edge 132 and the second longitudinal edge 134 are folded inwardly (i.e., towards the internal-facing surface 101 of the trim piece assembly 100) toward a hypothetical longitudinal midline 136 of the second trim piece 130 to form a tunnel structure that is referenced generally by the numeral 138. It is contemplated herein that the first longitudinal edge 132 may be spaced apart and unaffixed from the second longitudinal edge 134 of the second trim piece 130 after being folded inwardly as shown in FIG. 1. It is also contemplated herein, that the first longitudinal edge 132 may abut or touch but be unaffixed from the second longitudinal edge 134 after the edges 132 and 134 are folded inwardly. It is additionally contemplated herein, that the first longitudinal edge 132 may be affixed to the second longitudinal edge 134 after the edges 132 and 134 are folded inwardly to form an enclosed tunnel structure 138. Any and all aspects, and any variation thereof, are contemplated as being within aspects herein.

FIG. 1 depicts the second trim piece 130 as partially positioned within the space 128 formed between the opposing surfaces of the exterior layer 110 and the first trim piece 118 to better illustrate the positional relationships between the different parts of the trim piece assembly 100. However, it is contemplated herein that the second trim piece 130 is entirely positioned within the space 128 formed between the opposing surfaces of the exterior layer 110 and the first trim piece 118 when the trim piece assembly 100 is incorporated into an article of apparel. After being positioned within the space 128, the first longitudinal edge 132 and the second longitudinal edge 134 of the second trim piece 130 are in a generally parallel alignment with the perimeter edge 112 of the exterior layer 110, the lining layer edge 116 of the lining layer 114, the first edge 120 of the first trim piece 118, and the second edge 122 of the first trim piece 118. After being positioned within the space 128, the first longitudinal edge 132 and the second longitudinal edge 134 of the second trim piece 130 are positioned adjacent to and/or abut the first trim piece 118. In example aspects, the second trim piece 130 is affixed to first trim piece 118 at seam line 140 and seam line 142 (both shown using a dot-and-dash line broken line) using, for instance, stitching although other affixing technologies are contemplated herein. To avoid having topstitching showing on the external-facing surface of an article of apparel incorporating the trim piece assembly 100, the second trim piece 130 is not affixed to or is unaffixed from the exterior layer 110.

The trim piece assembly 100 further includes a drawcord 144 positioned within the tunnel structure 138 formed by the second trim piece 130. As explained further below, the drawcord 144 can be used to tension the perimeter edge 112 of the exterior layer 110 to achieve, for instance, a generally circumferential tightening of a face opening of a hood, or a waistband of an upper-body garment or a lower-body garment. The drawcord 144 may include a non-elastic cord or string, an elastic cord or string, or the drawcord 144 may include, for instance, an elastic band that tensions the perimeter edge 112 of the exterior layer 110. In some instances, such as when the drawcord 144 is an elastic band, the drawcord 144 may comprise a continuous structure that extends without interruption through the tunnel structure 138. In other instances, the drawcord 144 may include two terminal ends which may be manipulated by a wearer to tension the perimeter edge 112 of the exterior layer 110.

Figure 2:
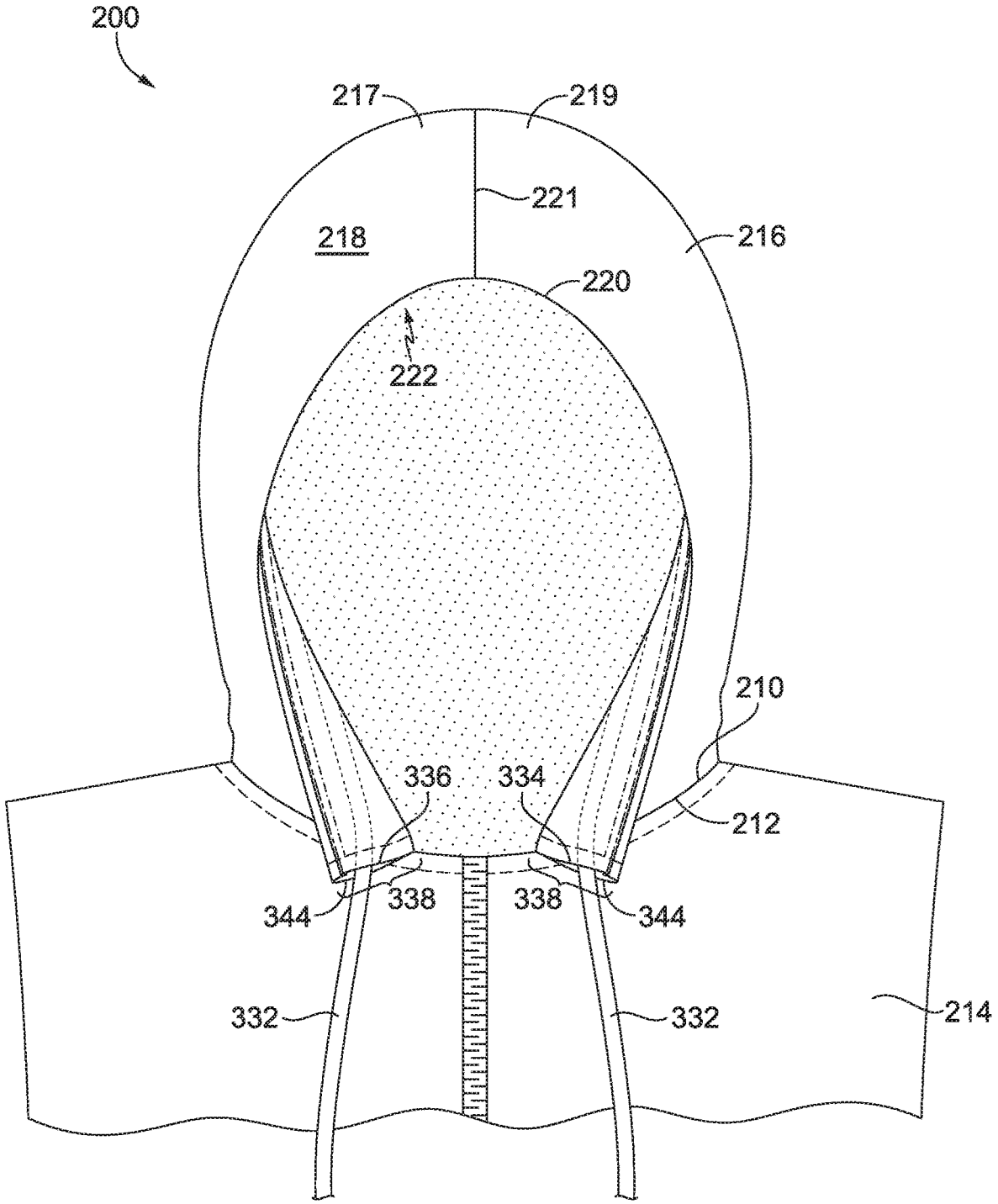
FIG. 2 illustrates a front, external view of a hood incorporating a trim piece assembly, such as the trim piece assembly of FIG. 1 in accordance with aspects herein.
Figure 3:
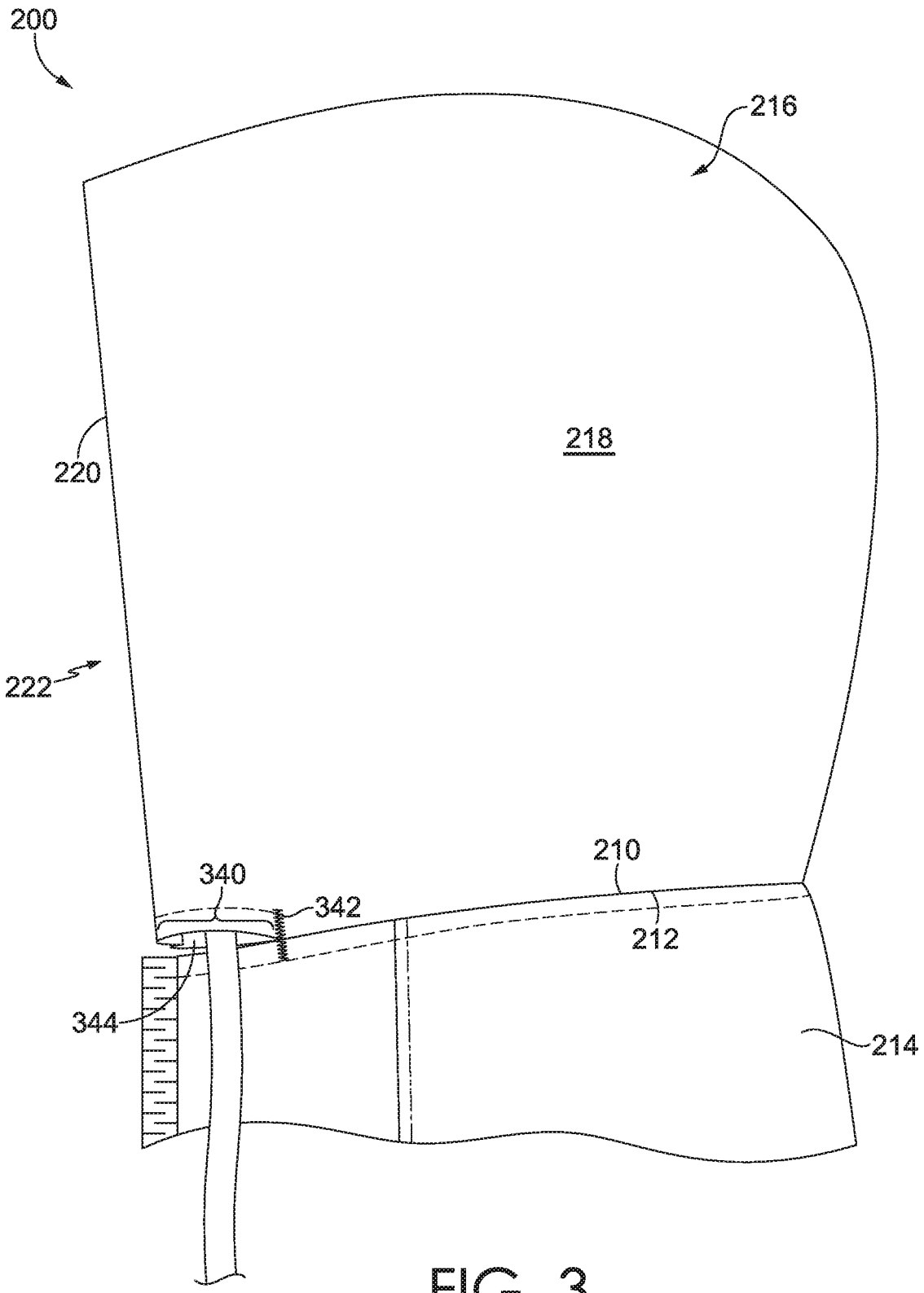
FIG. 3 illustrates a side, external view of the hood of FIG. 2 in accordance with aspects herein.

FIGS. 2 and 3 illustrate respectively a front, external view and a side, external view of an article of apparel in the form of a hood 200 incorporating a trim piece assembly, such as the trim piece assembly 100 of FIG. 1. In example aspects, a portion of a lower edge 210 of the hood 200 is affixed to a neck opening 212 of an upper-body garment 214. The upper-body garment 214 may be a jacket, a vest, a hoodie, a pullover, and the like. An external-facing surface 216 of the hood 200 is formed from an exterior layer 218 which may be, for instance, the exterior layer 110 of the trim piece assembly 100 shown in FIG. 1. The exterior layer 218 may be a fleece material (e.g., a material with a soft pile) to provide warmth to the hood 200. In some example aspects, the exterior layer 218 may include a right exterior layer 217 and a left exterior layer 219 that are joined at a midline of the hood 200 as indicated by seam line 221. This is just one example, and it is contemplated herein that the exterior layer 218 may comprise a single panel without the seam line 221. It is additionally contemplated herein that the exterior layer 218 may include multiple panels joined by seam lines. The exterior layer 218 includes a perimeter edge 220 that forms or defines a face opening 222 of the hood 200. As illustrated, there is no visible topstitching or seam lines on the exterior layer 218 in areas adjacent to the face opening 222 to create a clean aesthetic for the hood 200.

Figure 4:
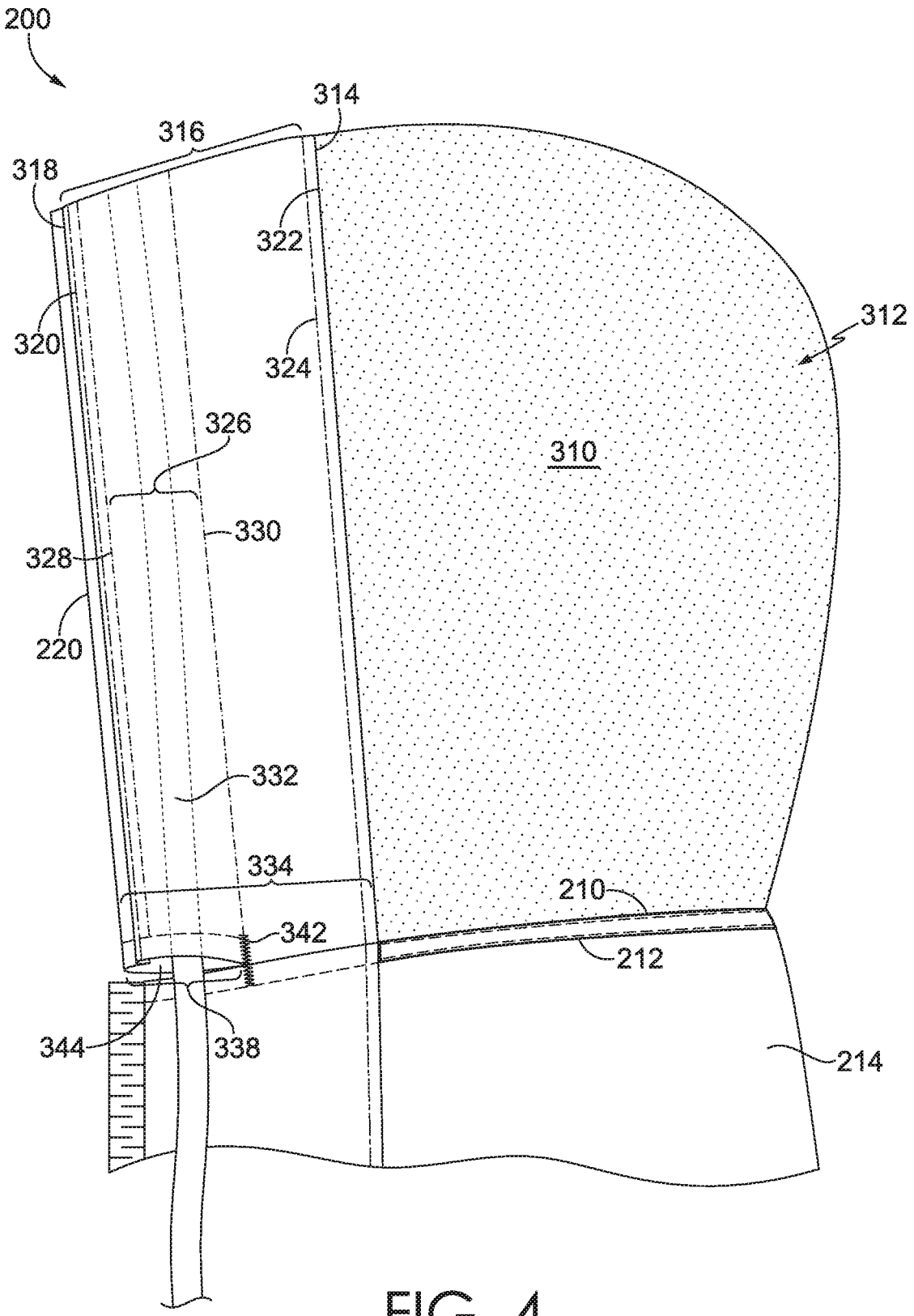
FIG. 4 illustrates a side, internal view of the hood of FIG. 2 in accordance with aspects herein.

FIG. 4 illustrates a side, internal view of the hood 200. The hood 200 is at least partially lined with a lining layer 310 which may be the lining layer 114 of the trim piece assembly 100. In example aspects, the lining layer 310 may include a single knit jersey to reduce manufacturing costs, increase the drape and/or pliability of the material, and to reduce the weight of the hood 200. It is contemplated herein that the lining layer 310 lines the sides, top and back of the hood 200 to at least partially form an internal-facing surface 312 of the hood 200. The lining layer 310 includes a lining layer edge 314 that is offset inwardly from the perimeter edge 220 of the exterior layer 218. In example aspects, the lining layer edge 314 may be offset inwardly from the perimeter edge 220 from about 4 cm to about 6 cm, or about 5 cm. As used herein, the term "about" means within ±10% of an indicated value. Offsetting the lining layer edge 314 from the perimeter edge 220 by the above range provides a consistent appearance between the external-facing surface 216 of the hood 200 and the portion of the hood 200 immediately adjacent but internal to the perimeter edge 220 of the exterior layer 218 since the same material (e.g., a fleece material) is used for the exterior layer 218 and the first trim piece, while a different material (e.g., a single jersey knit) may be used for the lining layer 310 as discussed above.

The internal view of FIG. 4 further depicts a first trim piece 316 such as the first trim piece 118 of the trim piece assembly 100. The first trim piece 316 includes a first edge 318 that is affixed to the perimeter edge 220 of the exterior layer 218 at seam line 320 (shown as a long-and-short broken line). The first trim piece 316 further includes a second edge 322 that is affixed to the lining layer edge 314 of the lining layer 310 at seam line 324 (shown as a long-and-short broken line). Although not visible due to the first trim piece 316, the hood 200 further includes a second trim piece, referenced generally by the numeral 326, positioned in a space formed between opposing surfaces of the first trim piece 316 and the exterior layer 218, where the second trim piece 326 includes longitudinal edges that are folded inwardly toward a longitudinal midline to form a tunnel structure. In example aspects, the tunnel structure formed by the second trim piece 326 has a width between about 2.5 cm and 3.5 cm or about 3 cm. The second trim piece 326 is affixed to the first trim piece 316 at seam lines 328 and 330 (both shown as a dot-and-dash broken line). As described above, the second trim piece 326 is not affixed to the exterior layer 218 to avoid topstitching being visible on the external-facing surface 216 of the hood 200 in areas where the trim piece assembly is located. The hood 200 additionally includes a drawcord 332 positioned within the tunnel structure formed by the second trim piece 326.

In example aspects, the first trim piece 316 includes a first terminal end 334 (shown in FIGS. 2 and 4) and a second terminal end 336 (partially shown in FIG. 2). In one example construction, the first terminal end 334 and the second terminal end 336 of the first trim piece 316 may be partially attached to and partially detached from the neck opening 212 of the upper-body garment 214. For instance, a first portion 338 of the first terminal end 334 and the second terminal end 336 is detached from the neck opening 212 of the upper-body garment 214, where the first portion 338 extends inwardly from the first edge 318 of the first trim piece 316 for a distance of about 2.5 cm to about 3.5 cm, or about 3 cm. Additionally, as shown in FIG. 3, a first portion 340 of the lower edge 210 of the exterior layer 218 is detached from the neck opening 212 of the upper-body garment 214, where the first portion 340 extends inwardly from the perimeter edge 220 of the exterior layer 218 for a distance of about 2.5 cm to about 3.5 cm, or about 3 cm. Thus, there is a spatial correspondence between where the first portion 338 of the first trim piece 316 and the first portion 340 of the exterior layer 218 terminate.

At the point where the first portion 338 of the first trim piece 316 and the first portion 340 of the exterior layer 218 terminate and the first trim piece 316 and the exterior layer 218 attach to the neck opening 212 of the upper-body garment, the first trim piece 316 and the exterior layer 218 are affixed as indicated by the reference numeral 342 to form an opening 344 through which the drawcord 332 extends. The point of affixation 342 may be in the form of a bartack. The construction thus described provides a clean, low-profile aesthetic as opposed to more traditional hood drawcord constructions where the drawcord exits a tunnel structure by way of an opening extending through a layer of material that forms the exterior of the hood. The construction also provides easy access to the drawcord 332 for tensioning the face opening 222 of the hood 200.

Figure 5:
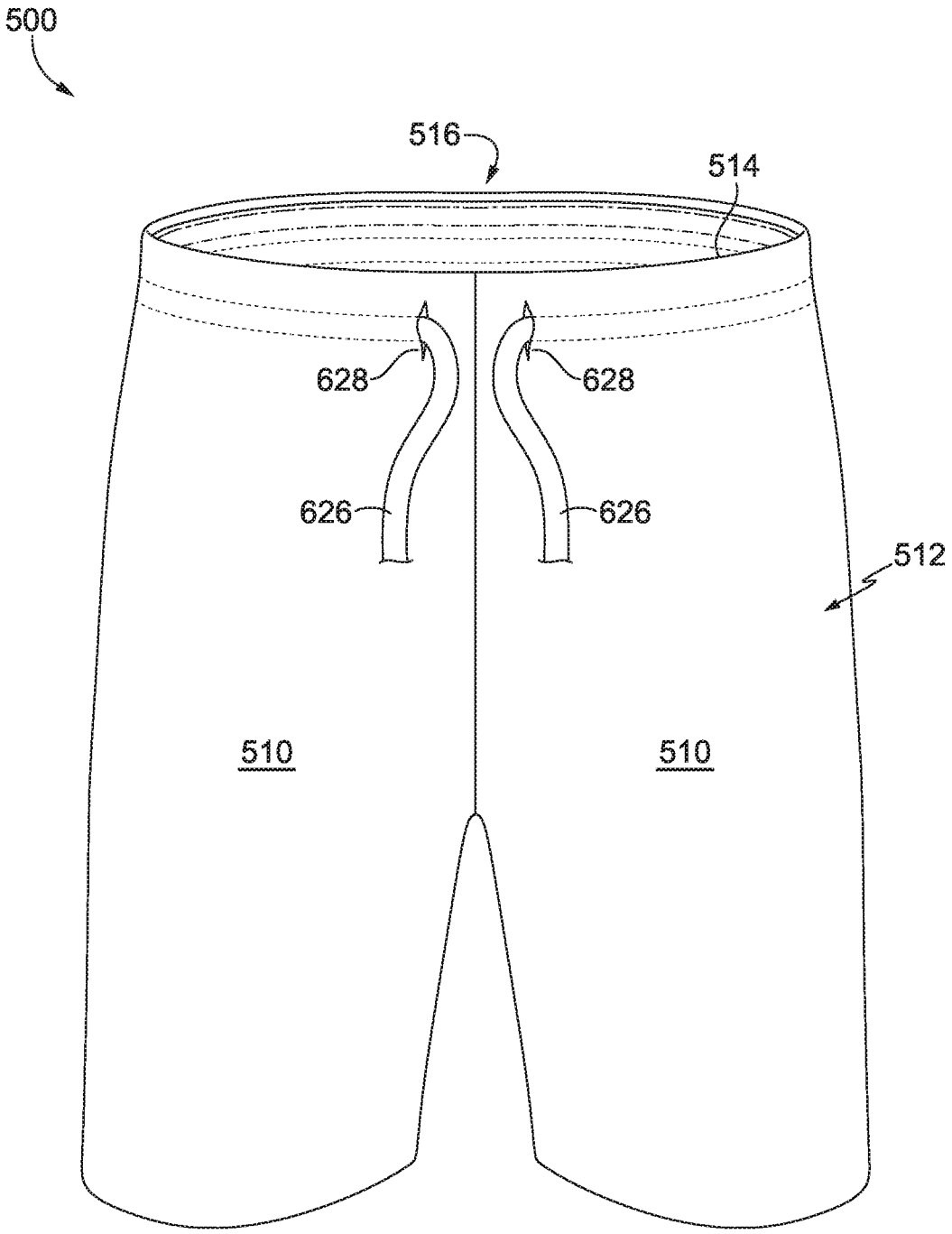
FIG. 5 illustrates a front, exterior view of a lower-body garment incorporating a trim piece assembly, such as the trim piece assembly of FIG. 1 in accordance with aspects herein.
Figure 6:
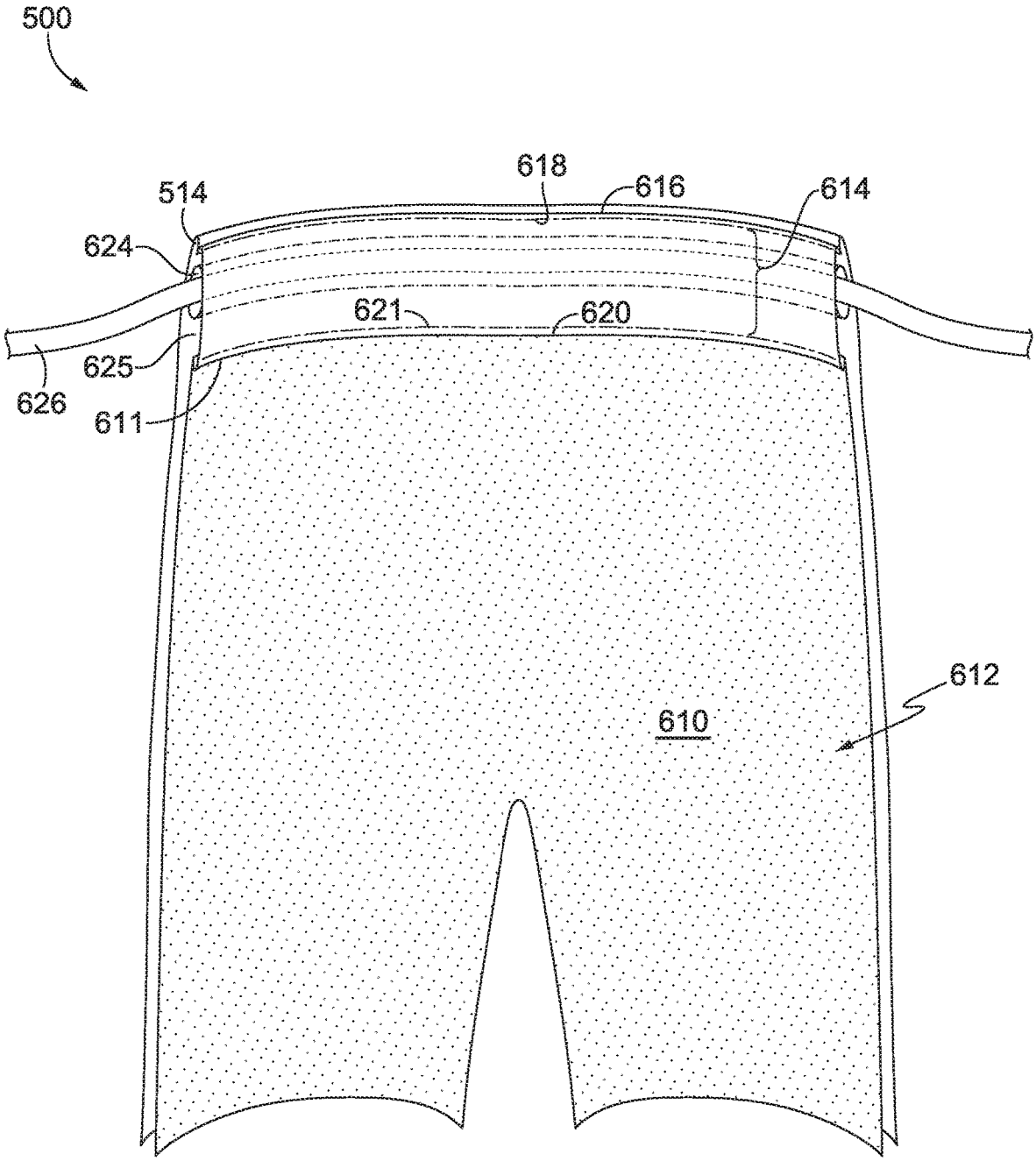
FIG. 6 illustrates a cut-away view of the interior of the lower-body garment of FIG. 5 in accordance with aspects herein.

The trim piece assembly 100 may also be used in other articles of apparel such as a lower-body garment as shown in FIGS. 5 and 6. FIG. 5 is a front, external view of a lower-body garment 500 in the form of a short, and FIG. 6 is a cut-away view of the interior of the lower-body garment 500 where a front half of the lower-body garment 500 is removed. Although shown as a short, it is contemplated herein that the lower-body garment 500 may include other forms such as a pant, a capri, a tight, and the like.

With respect to FIG. 5, the lower-body garment 500 includes an exterior layer 510, such as the exterior layer 110 of the trim piece assembly 100 that may form, in whole or in part, an external-facing surface 512 of the lower-body garment 500. The exterior layer 510 includes a perimeter edge 514 that forms a waist opening 516 of the lower-body garment 500.

With respect to FIG. 6, the lower-body garment 500 further includes a lining layer 610, such as the lining layer 114 of the trim piece assembly 100, that lines, in whole or in part, an interior of the lower-body garment 500 such that the lining layer 610 helps to form an internal-facing surface 612 of the lower-body garment 500. For example, the lining layer 610 may line, or partially line, a torso portion, a first leg portion, and a second leg portion of the lower-body garment 500. The lining layer 610 includes a lining layer edge 611.

The lower-body garment 500 also has a first trim piece 614, such as the first trim piece 118 of the trim piece assembly 100 that helps to form the internal-facing surface 612 of the lower-body garment 500 adjacent to the waist opening 516. The first trim piece 614 has a first edge 616 that is affixed to the perimeter edge 514 of the exterior layer 510 at seam line 618. The first trim piece 614 also has a second edge 620 that is affixed to the lining layer edge 611 of the lining layer 610 at seam line 621 (both seam line 618 and seam line 621 are shown as a long-and-short broken line).

The lower-body garment 500 also includes a second trim piece 624 positioned in a space 625 formed between the opposing surfaces of the first trim piece 614 and the exterior layer 510. The second trim piece 624 has a first longitudinal edge and a second longitudinal edge. The first and second longitudinal edges of the second trim piece 624 are folded inwardly toward a longitudinal midline of the second trim piece 624 to form a tunnel structure which houses a drawcord 626 which can be used to circumferentially tighten the waist opening 516 of the lower-body garment 500. The drawcord 626 may exit the tunnel structure by way of apertures 628, and the ends of the drawcord 626 are positioned on the front, exterior of the lower-body garment 500 as shown in FIG. 5. The use of the apertures 628 is just one example way that the drawcord 626 may exit the tunnel structure. Alternatively, a construction similar to that shown for the hood 200 may be used to form openings, such as the opening 344, through which the drawcord 626 extends. In another example, the drawcord 626 may comprise an elasticized band that extends circumferentially and without interruption around the waist opening 516 such that it does not exit the tunnel structure. Any and all aspects, and any variation thereof, are contemplated as being within aspects herein.

Although shown as being incorporated into the hood 200 and the lower-body garment 500, it is contemplated herein that the trim piece assembly 100 may be incorporated into any article of apparel in which a circumferential tightening of an opening is desired.

Figure 7:
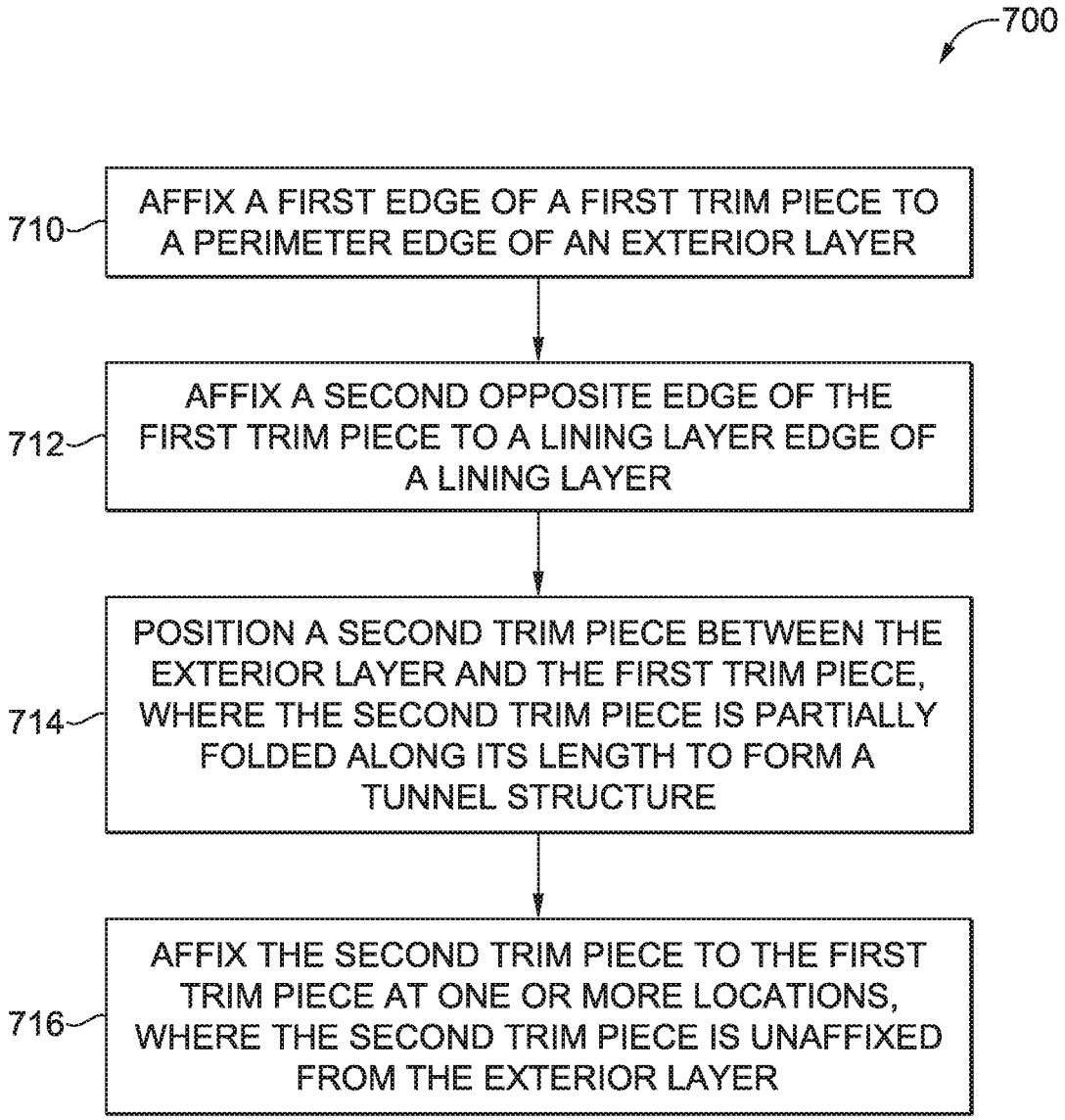
FIG. 7 illustrates a flow diagram of an example method of manufacturing an article of apparel incorporating a trim piece assembly, such as the trim piece assembly of FIG. 1 in accordance with aspects herein.

FIG. 7 depicts a flow diagram of an example method 700 of manufacturing a trim piece assembly for an article of apparel, such as the trim piece assembly 100. At a step 710, a first edge of a first trim piece, such as the first trim piece 118 of the trim piece assembly 100, is affixed to a perimeter edge of an exterior layer, such as the perimeter edge 112 of the exterior layer 110. The exterior layer at least partially forms an external-facing surface of the article of apparel. At a step 712, a second opposite edge of the first trim piece is affixed to a lining layer edge of a lining layer, such as the lining layer edge 116 of the lining layer 114. The lining layer at least partially forms an internal-facing surface of the article of apparel.

At a step 714, a second trim piece, such as the second trim piece 130, is positioned in a space formed between opposing surfaces of the exterior layer and the first trim piece. The second trim piece is at least partially folded along its length to form a tunnel structure. At a step 716, the second trim piece is affixed to the first trim piece at one or more locations. The second trim piece is not affixed to, or is unaffixed from the exterior layer to avoid having topstitching visible on the external-facing surface of the article of apparel. The method 700 may also include positioning a drawcord, such as the drawcord 144 within the tunnel structure formed by the second trim piece.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A hood for an upper-body garment, the hood comprising: an exterior layer at least partially forming an external-facing surface of the hood, the exterior layer having a perimeter edge that at least partially defines a face opening of the hood; a lining layer at least partially forming an internal-facing surface of the hood, the lining layer having a lining layer edge; a first trim piece positioned internal to the exterior layer, the first trim piece having a first edge affixed to the perimeter edge and a second edge affixed to the lining layer edge; and a second trim piece positioned between the first trim piece and the exterior layer, the second trim piece partially folded along its length to form a tunnel structure.

Clause 2. The hood for the upper-body garment of clause 1, further comprising a drawcord positioned in the tunnel structure.

Clause 3. The hood for the upper-body garment according to any of claims 1 through 2, wherein the second trim piece is affixed at one or more locations to the first trim piece.

Clause 4. The hood for the upper-body garment according to any of claims 1 through 3, wherein the second trim piece is unaffixed from the exterior layer.

Clause 5. The hood for the upper-body garment according to any of clauses 1 through 4, wherein the lining layer is unaffixed from the exterior layer.

Clause 6. The hood for the upper-body garment according to any of clauses 1 through 5, wherein the lining layer edge is offset from the perimeter edge by a distance of from about 4 cm to about 6 cm.

Clause 7. The hood of the upper-body garment according to any of clauses 1 through 6, wherein the lining layer edge is offset from the perimeter edge by a distance of about 5 cm.

Clause 8. The hood of the upper-body garment according to any of clauses 1 through 7, wherein the second trim piece includes a first longitudinal edge and a second longitudinal edge opposite the first longitudinal edge, and wherein each of the first longitudinal edge and the second longitudinal edge are folded toward a longitudinal midline of the second trim piece to form the tunnel structure.

Clause 9. The hood of the upper-body garment of clause 8, wherein the first longitudinal edge of the second trim piece is unaffixed from the second longitudinal edge of the second trim piece.

Clause 10. The hood of the upper-body garment according to any of clauses 8 through 9, wherein the first longitudinal edge and the second longitudinal edge of the second trim piece are positioned adjacent to the first trim piece.

Clause 11. The hood of the upper-body garment according to any of clauses 1 through 10, wherein the exterior layer is formed from a fleece fabric.

Clause 12. The hood of the upper-body garment according to any of clauses 1 through 11, wherein the lining layer is formed from a knit jersey fabric.

Clause 13. An article of apparel comprising: an exterior layer at least partially forming an external-facing surface of the article of apparel, the exterior layer having a perimeter edge that at least partially defines a circumferential opening of the article of apparel; a lining layer at least partially forming an internal-facing surface of the article of apparel, the lining layer having a lining layer edge; a first trim piece positioned internal to the exterior layer, the first trim piece having a first edge affixed to the perimeter edge and a second edge affixed to the lining layer edge; and a second trim piece positioned between the first trim piece and the exterior layer, the second trim piece partially folded along its length to form a tunnel structure.

Clause 14. The article of apparel of clause 13, wherein the article of apparel is a lower-body garment, and wherein the circumferential opening is a waist opening of the lower-body garment.

Clause 15. The article of apparel according to any of clauses 13 through 14, wherein the article of apparel is a hood for an upper-body garment, and wherein the circumferential opening is a face opening of the hood.

Clause 16. The article of apparel according to any of clauses 13 through 15, further comprising a drawcord positioned within the tunnel structure.

Clause 17. The article of apparel according to any of clauses 13 through 16, wherein the second trim piece is affixed at one or more locations to the first trim piece, and wherein the second trim piece is unaffixed from the exterior layer.

Clause 18. A method of manufacturing a trim piece assembly for an article of apparel, the method comprising: affixing a first edge of a first trim piece to a perimeter edge of an exterior layer, the exterior layer at least partially forming an external-facing surface of the article of apparel; affixing a second opposite edge of the first trim piece to a lining layer edge of a lining layer, the lining layer at least partially forming an internal-facing surface of the article of apparel; positioning a second trim piece between the exterior layer and the first trim piece, wherein the second trim piece is at least partially folded along its length to form a tunnel structure; and affixing the second trim piece to the first trim piece at one or more locations, wherein the second trim piece is unaffixed from the exterior layer.

Clause 19. The method of manufacturing the trim piece assembly for the article of apparel of clause 18, further comprising positioning a drawcord within the tunnel structure.

Clause 20. The method of manufacturing the trim piece assembly for the article of apparel according to any of clauses 18 through 19, wherein the article of apparel is a hood.

Clause 21. An upper-body garment having a hood, wherein a lower edge of the hood is at least partially attached to a neck opening of the upper-body garment, the hood comprising: an exterior layer at least partially forming an external-facing surface of the hood, the exterior layer having a perimeter edge that at least partially defines a face opening of the hood; a lining layer at least partially forming an internal-facing surface of the hood, the lining layer having a lining layer edge; a first trim piece positioned internal to the exterior layer, the first trim piece having a first edge affixed to the perimeter edge and a second edge affixed to the lining layer edge; a second trim piece positioned between the first trim piece and the exterior layer, the second trim piece partially folded along its length to form a tunnel structure; and a drawcord positioned within the tunnel structure.

Clause 22. The upper-body garment having the hood of clause 21, wherein the first trim piece includes a first terminal end at least partially attached to the neck opening of the upper-body garment on a first side of the face opening and a second terminal end at least partially attached to the neck opening of the upper-body garment on a second opposite side of the face opening Clause 23. The upper-body garment having the hood according to clause 22, wherein each of the first terminal end and the second terminal end of the first trim piece includes a first portion that is detached from the neck opening of the upper-body garment, and wherein the first portion of the first terminal end and the second terminal end extends inwardly from the first edge of the first trim piece to a first location from about 2.5 cm to about 3 cm from the first edge.

Clause 24. The upper-body garment having the hood according of clause 23, wherein the exterior layer includes a first portion that is detached from the neck opening of the upper-body garment on the first side and the second opposite side of the face opening, and wherein the first portion of the exterior layer extends inwardly from the perimeter edge of the exterior layer to a second location from about 2.5 cm to about 3 cm from the perimeter edge, wherein the second location spatially corresponds to the first location.

Clause 25. The upper-body garment having the hood of clause 24, wherein the exterior layer is affixed to the first terminal end and the second terminal end of the first trim piece at the respective first location and the second location to form a first opening on the first side of the face opening and a second opening on the second side of the face opening, and wherein the drawcord extends through the first opening and the second opening.

Clause 26. A combination waistband and lower-body garment comprising: an exterior layer at least partially forming an external-facing surface of the lower-body garment, the exterior layer having a perimeter edge that at least partially defines a waist opening of the lower-body garment; a lining layer at least partially forming an internal-facing surface of the hood, the lining layer having a lining layer edge; a first trim piece positioned internal to the exterior layer, the first trim piece having a first edge affixed to the perimeter edge and a second edge affixed to the lining layer edge; and a second trim piece positioned between the first trim piece and the exterior layer, the second trim piece partially folded along its length to form a tunnel structure.

Clause 27. The combination waistband and lower-body garment according to clause 26, further comprising a drawcord positioned in the tunnel structure.

Clause 28. The combination waistband and lower-body garment according to any of clauses 26 through 27, wherein the second trim piece is affixed at one or more locations to the first trim piece.

Clause 29. The combination waistband and lower-body garment according to any of clauses 26 through 28, wherein the second trim piece is unaffixed from the exterior layer.

Clause 30. The combination waistband and lower-body garment according to any of clauses 26 through 29, wherein the lining layer edge is offset from the perimeter edge by a distance of from about 4 cm to about 6 cm.

Clause 31. The combination waistband and lower-body garment according to clause 30, wherein the lining layer edge is offset from the perimeter edge by a distance of about 5 cm.

Clause 32. The combination waistband and lower-body garment according to any of clauses 26 through 31, wherein the lower-body garment comprises a short.

Clause 33. The combination waistband and lower-body garment according to any of clauses 26 through 31, wherein the lower-body garment comprises a pant.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An article of apparel comprising:

an exterior layer comprising at least a portion of an external-facing surface of the article of apparel, the exterior layer having a perimeter edge that at least partially defines a circumferential opening of the article of apparel;

a lining layer comprising at least a portion of an internal-facing surface of the article of apparel, the lining layer having a lining layer edge;

a first trim piece positioned internal to the exterior layer, the first trim piece having a first edge folded towards the exterior layer and affixed to the perimeter edge and a second edge affixed to the lining layer edge, wherein the second edge of the first trim piece and the lining layer edge are not directly affixed to the exterior layer;

a second trim piece positioned between the first trim piece and the exterior layer, the second trim piece partially folded along a length of the second trim piece to form a tunnel structure and;

a drawcord positioned within the tunnel structure formed from the second trim piece.

2. The article of apparel of claim 1, wherein the second trim piece is affixed at one or more locations to the first trim piece.

3. The article of apparel of claim 2, wherein the second trim piece is not directly affixed to the exterior layer.

4. The article of apparel of claim 1, wherein the lining layer edge is offset from the perimeter edge by a distance of from about 4 cm to about 6 cm.

5. The article of apparel of claim 4, wherein the lining layer edge is offset from the perimeter edge by a distance of about 5 cm.

6. The article of apparel of claim 1, wherein the second trim piece includes a first longitudinal edge and a second longitudinal edge opposite the first longitudinal edge, and wherein each of the first longitudinal edge and the second longitudinal edge are folded toward a longitudinal midline of the second trim piece to form the tunnel structure.

7. The article of apparel of claim 6, wherein the first longitudinal edge of the second trim piece is not directly affixed to the second longitudinal edge of the second trim piece.

8. The article of apparel of claim 6, wherein the first longitudinal edge and the second longitudinal edge of the second trim piece are positioned adjacent to the first trim piece.

9. The article of apparel of claim 1, wherein the article of apparel is a lower-body garment, and wherein the circumferential opening is a waist opening of the lower-body garment.

10. The article of apparel of claim 9, wherein the lining layer lines an interior of the lower-body garment.

11. The article of apparel of claim 9, further comprising one or more apertures extending through the exterior layer, wherein ends of the drawcord extend through the one or more apertures such that the ends of the drawcord are positioned on a front portion of the external-facing surface of the lower-body garment.

12. The article of apparel of claim 11, wherein the drawcord comprises an elasticized band that extends circumferentially and without interruption around the waist opening.

13. The article of apparel of claim 9, wherein the lower-body garment comprises a short.

14. The article of apparel of claim 9, wherein the lower-body garment comprises a pant.

15. An article of apparel comprising:

an exterior layer comprising at least a portion of an external-facing surface of the article of apparel, the exterior layer having a perimeter edge that at least partially defines a circumferential opening of the article of apparel and a first terminal end at an opening to a space for housing a drawcord;

a lining layer comprising at least a portion of an internal-facing surface of the article of apparel, the lining layer having a lining layer edge;

a first trim piece positioned internal to the exterior layer and comprising a same material as the exterior layer, the first trim piece having a first edge affixed to the perimeter edge and a second edge affixed to the lining layer edge, wherein the first trim piece comprises a second terminal edge at the opening to the space for housing the drawcord; and a second trim piece positioned between the first trim piece and the exterior layer, the second trim piece partially folded along a length to form a tunnel structure, wherein the second trim piece is not directly affixed to the exterior layer wherein the second trim piece comprises a third terminal end that is offset within the space for housing the drawcord and away from the first terminal end and the second terminal end.

* * * * *